US008991135B2

(12) United States Patent
Schitter

(10) Patent No.: US 8,991,135 B2
(45) Date of Patent: Mar. 31, 2015

(54) LIGHTWEIGHT STRUCTURAL PANEL AND METHOD FOR MAKING SAME

(75) Inventor: Leonhard Schitter, Hallwang (AT)

(73) Assignee: M. Kaindl, Wals/Salzburg (AT)

( * ) Notice: Subject to any disclaimer, the term of this patent is extended or adjusted under 35 U.S.C. 154(b) by 2409 days.

(21) Appl. No.: 11/575,283

(22) PCT Filed: Aug. 4, 2005

(86) PCT No.: PCT/EP2005/053855
§ 371 (c)(1),
(2), (4) Date: Mar. 14, 2007

(87) PCT Pub. No.: WO2006/037679
PCT Pub. Date: Apr. 13, 2006

(65) Prior Publication Data

US 2008/0060319 A1 Mar. 13, 2008

(30) Foreign Application Priority Data

Oct. 4, 2004 (DE) ..... 20 2004 015 471 U

(51) Int. Cl.
*E04C 2/30* (2006.01)
*E04C 2/36* (2006.01)
*E04C 2/38* (2006.01)

(52) U.S. Cl.
CPC ..... *E04C 2/365* (2013.01); *E04C 2/386* (2013.01)
USPC ..... 52/745.19

(58) Field of Classification Search
USPC ..... 52/782.1, 782.2, 782.24, 783.1, 588.1, 52/745.05, 745.19
See application file for complete search history.

(56) References Cited

U.S. PATENT DOCUMENTS

| | | | | |
|---|---|---|---|---|
| 2,719,809 | A | 10/1955 | Herts | |
| 3,127,304 | A * | 3/1964 | Borup | 428/106 |
| 5,253,409 | A * | 10/1993 | Bier et al. | 29/424 |
| 5,369,930 | A * | 12/1994 | Kreizinger | 52/745.2 |
| 5,832,692 | A * | 11/1998 | Opferbeck et al. | 52/745.19 |
| 5,975,180 | A | 11/1999 | Durinck | |

FOREIGN PATENT DOCUMENTS

| | | | |
|---|---|---|---|
| CN | 86107430 | A | 6/1987 |
| CN | 1079798 | A | 12/1993 |
| CN | 1378894 | A | 11/2002 |
| DE | 29614723 | | 1/1997 |
| DE | 19544653 | | 4/1997 |
| DE | 10313055 | | 10/2004 |
| EP | 1029665 | | 8/2000 |
| GB | 157204 | | 1/1922 |
| WO | 2004085152 | | 10/2004 |

OTHER PUBLICATIONS

International Search Report for PCT/EF2005/053855.
English Language Translation of International Preliminary Examination Report for PCT/EP2005/053855.

* cited by examiner

*Primary Examiner* — William Gilbert
(74) *Attorney, Agent, or Firm* — Andrew M. Calderon; Roberts Mlotkowski Safran & Cole, P.C.

(57) ABSTRACT

The invention relates to an improved lightweight panel, novel uses thereof, as well as to an improved method for manufacturing the same.

46 Claims, 1 Drawing Sheet

LIGHTWEIGHT STRUCTURAL PANEL AND METHOD FOR MAKING SAME

BACKGROUND OF THE INVENTION

1. Field of the Invention

The invention relates to a lightweight panel, to its use, as well as to a method for manufacturing the same.

2. Discussion of Background Information

Lightweight panels are used for furniture, doors, walls and the like, because they give the impression of a modern design and high quality at low weight. Thus, the impression of massive shelf units with a width of 5 cm may arise. Starting at a panel thickness of approx. 3 cm, the lightweight panels manufactured according to the state of the art described below have an advantage as regards costs over massive panels, such as chipboard, HDF and MDF panels, for example.

The small specific weight of the lightweight panels reduces the costs for transport and production, makes handling easier during assembly, permits a weaker structural design of the furniture due to their smaller weight, permits the use of fixtures with a weaker structural design because the doors, for example, weigh less, they are cheaper, require lighter, less rugged and, thus, cheaper packaging, and finally is an incentive to buy in the case of self-assembled furniture, because the lighter product can be transported and assembled better by anyone.

Known lightweight panels consist of a light insert whose top and bottom sides are connected to a cover layer. Typical inserts are, e.g., inserts of paper honeycombs or corrugated material, as well as polystyrene foam or rigid PU foam. What is essential with regard to the insert is that the honeycombs protect the two cover layers against compression or stretching and displacement. Paper structures extending in the direction of the thickness, e.g. tubes, honeycombs, triangles, or other structures, which are resistant particularly in the direction of the thickness, are particularly widespread. The cover layers are thin panels, mainly derived timber products, with a thickness of about 3 to 6 mm, whose externally visible surface is either provided with a foil, laminated, printed or varnished for reasons of appearance, or to prevent abrasion or ingress of dirt, moisture and the like. The edges of a lightweight panel may optionally be provided with so-called bars, which mostly are massive. They form the third essential element of a lightweight panel and mainly serve as longitudinal and transversal bars. In the area of the edge, they are fastened between the cover layers instead of the insert, or glued to the edges, they form the edges of the lightweight panel, prevent ingress of foreign substances into the panel, give stability to the edge, contribute to the flexural and twist rigidity of the panel and serve as a fastening for connecting elements, for example for creating a body element from several lightweight panels. In that case, the bars must be integrated into the panels in such a manner that, for example, the forces arising at the corner joint can be absorbed, or that the fastening elements, such as bolt and counter-nut can be sufficiently secured. Suitable materials for bars are usually massive wood, MDF, HDF, chipboards.

Lightweight panels 1 as they are shown, for example, in FIGS. 1 and 2, are manufactured as follows according to the state of the art: the base panel 21 forming the bottom cover layer 2 is placed with the surface 22 that is visible later on facing downwards, and its top surface is provided with glue in its entirety. The longitudinal and transversal bars 41, 42 that have been cut to measure before are laid along the side surfaces of the bottom cover layer 2 onto its pre-glued surface 11. A provisional connection of the longitudinal and transversal bars 41, 42 established before or after this, for example by means of staples 43, in this case provides for an improved dimensional stability and accelerates the working process during the subsequent handling steps. Then, the paper honeycomb panel 3, which has the same height as the bars 4, is laid into the space between the bars. The bottom edge of the honeycombs 3 thus connects to the glued surface 12 of the bottom cover layer. Then, the second cover panel 5 (base 51 and surface 52), whose surface, which is invisible later on, has also been provided with glue before, is laid onto the still-open lightweight panel, such that it can engage in a glued connection with the top side of the bars and honeycombs. Now, the two cover layers of the lightweight panel are pressed against each other while the glue 11, 12 hardens. In order to save time and press capacity, a plurality of lightweight panels are usually stacked one on top of the other and pressed together, and they then harden while being weighted. The manufacture, which takes time and requires a lot of personnel, can be made simpler by using broader bars in the interior, i.e. not in the area of the edges, the bars being laid onto the base panel, for example, in a trussed manner. After hardening, a plurality of smaller lightweight panels are obtained by sawing the large lightweight panel formed thus in the area of the middle of the interior longitudinal and transversal bars.

The method outlined above, which is reminiscent of handicraft techniques, has various disadvantages that prevented their use in mass production until now. Inserting and cutting the bars to size is precision work. Due to the honeycomb structure, a large part of the glue is not used for gluing but hardens unused on the inner sides of the cover layers. The slow hardening process of the glue makes a continuous process impossible because the drying time is several hours. Further problems are the result. For example, commercially available water-based glues, such as, for example, urea glue and PVAC, dry out due to evaporation of moisture. In the process, the paper insert and the cover layer may be weakened. The results is visible unevenness due to deformation of the insert and the cover layer itself. This is the reason why a further step, namely the calibration of the finished, hardened panel is often necessary for obtaining the desired even surface.

SUMMARY OF THE INVENTION

The present invention provides an improved lightweight panel, a new use of the same, as well as an improved method for manufacturing the same.

This is solved by a method for manufacturing lightweight panels, a lightweight panel, the use of a lightweight panel and an apparatus for carrying out the method according to the corresponding claims. Advantageous embodiments are the subject matter of the dependent claims.

It is at first proposed, in the method according to the invention, that gluing be carried out while applying line pressure between cover layer and insert and, if necessary, the bars. Line pressure within the sense of the invention is merely the local application of pressure moving relative to the component. Line pressure may, for example, be applied by means of a roller rolling over the component. The advantage of localized pressures is that a small pressuring force must be applied, in comparison to the pressing of the entire component, because it is not the entire panel that is subjected to pressure at one time. A line pressure within the sense of the invention may also be applied by means of a belt that is carried along together with the component and that is supported or borne on the other side, for example, by castors. Thus, contrary to the word "line", the line pressure may also be applied in an area-like region. The advantage of a line pressure applied, according to the invention, along the lightweight panel to be formed is that the work can be carried out continuously, instead of in intervals. Because it is known in the state of the art to discontinually press panels individually or in stacks under pressure.

A lightweight panel within the sense of the invention is at hand if the insert consists of a material with less specific density than a comparable massive panel, e.g. a panel of massive wood, chipboard or MDF, wherein the material at least stiffens the cover layer. A lightweight panel is already at hand when the cover layer is attached to only one side of the insert, because this possibly already ensures a sufficient stability, i.e. reinforcement of the cover layer. The manufacture disclosed according to the invention of a lightweight panel with an insert glued together with the cover layer on only one side also makes sense if only a semi-finished product is manufactured. It may in that case be provided, for example, that a cover layer of another material, or at least with different material properties and/or material thickness, can be applied to the other side of the insert in another step, wherein this second cover layer cannot be processed by the method according to the invention.

If the line pressure is guided along the lightweight panel several consecutive times, it is possible to subject the lightweight panel to be formed to pressure for a long period of time during manufacture, wherein each apparatus which applies the line pressure need only have a small contact force in relation to the entire surface of the lightweight panel. Thus, the purchase of expensive presses with large pressing forces can be dispensed with. The application of line pressure, for example by rollers, has the further advantage that a subsequent calendering of the surface of the lightweight panel can be dispensed with.

This applies especially when the line pressure(s) are exerted until a complete hardening of the glue used has occurred. In this case, the following glues are particularly suitable:

a) of the physically setting types, for example, hot melt adhesives, because merely placing the gluing surfaces against each other already suffices for forming a bond, and further more, because an application of the glue on one side is sufficient.
b) of the cold-setting types, e.g., cements as aqueous dispersion, because in their case, an application on one side is also sufficient.

Therefore, suitable glues are, for example, NR (natural rubbers), glues (e.g. glutine glues), UF resins, MF resins, PF resins, RF resins, starch, dextrin, casein, PVAL, PVP, cellulose ether and PU adhesive.

Hardening within the sense of the invention has occurred, when the contact pressure can be lifted without any loss of quality worth mentioning and if a further handling of the panels is ensured during production without them incurring any loss of quality due to the glue not having hardened completely. In particular, it must be ensured that the connection between the cover layer and the insert or the bar cannot break or that the surface of the cover layer becomes uneven.

Endless panel within the sense of the invention means that they, in relation to the end product, i.e. the finished lightweight panel that is, for example, ready for shipping and sale, have a greater length and that they are joined, not in intervals, but rather continuously.

The bars serving as longitudinal bars, which substantially have the same thickness as the inserts do, serve the purpose of stiffening the finished lightweight panels in the area of the edges, as do the transversal bars. If the endless panels are provided with longitudinal bars, the result is a more efficient manufacture in comparison with the conventional method of production, because the longitudinal bars need not be cut to panel length, or multiples thereof. Rather, this is done in a further step, when the already finished and hardened lightweight panel is distributed. There is less work and offcut involved with the bars.

If only longitudinal bars are used exclusively in the production of the lightweight panels, and if, subsequently, the endless panel is divided in a direction transversal to the longitudinal bars, the process step of inserting transversal bars can be dispensed with. Depending on the application of the panel, the side that has been cut off is not visible, i.e. in the case of panels that have-been placed next to each other or that have been joined at an angle.

Furthermore, the longitudinal bars, in the method according to the invention for the continuous manufacture of lightweight panels, can also be arranged in an offset manner relative to the dimensions of the lightweight panels that are to be cut off later. This makes a special adjustment of the longitudinal bars to the subsequent measurements of the panels or the multiples thereof superfluous, and there is no offcut. Preferably, however, the longitudinal bars that abut each other are connected joined provisionally, for example, by means of metal staples, so that no gaps may arise between the end faces of the bars during pressing later on.

Dividing the endless panel, for example by sawing, in the area of the bars is particularly efficient, because a single bar thus forms the edge of two lightweight panels that adjoin each other after dividing. In this case, the edge, due to the dividing, possibly is in a state which does not require any finishing.

A particularly attractive lightweight panel posing, possibly, very little risk of injury, is obtained when the edges and corners of the individual lightweight panels are processed in order to round them off, for example, or to bring them into a certain shape. This is done particularly efficiently, if such a shape is formed already during dividing, e.g. by milling machines. This renders unnecessary further handling for the purpose of processing the panel. Furthermore, offcut can be reduced if the particular shapes of two adjacent lightweight panels fit into each other.

The subsequent reinforcement of the edges, for example, after dividing, is an alternative for the insertion of longitudinal or transversal bars. The corresponding space can be created, for example, by compressing, milling out or pulling the insert, which yields in the direction transversal to the panel plane, or by keeping the corresponding space free from the start. Then, the space may be filled with bars, or with foam. Finally, it is also possible to reinforce the edges by gluing on strips, in particular strips that have connecting means protruding towards the interior of the panel and that can engage in a connection with the insert, for example, by means of barbs.

If the endless panel has at least three longitudinal bars, then the manufacture of several parallel webs is possible at the same time when dividing in the area of the inner longitudinal bars. It is also cheaper, with regard to the machines, to carry out the method with one broad apparatus instead of with several narrow apparatuses. Thus, production can be doubled in the case of three longitudinal bars, tripled, in the case of four longitudinal bars and so forth.

A considerably lower consumption of glue than in the state of the art is the result if the glue is only applied, where a gluing contact is actually to be established. I.e., the cover layer is not wholly perfused with glue over the entire area, but only in the area of the bars, which can, of course, also be done by the glue being applied only on the bar. A similar procedure arises for the insert, which naturally only takes up glue in the area actually needed for the connection. An application of glue with rollers is problematic, at least in the case of quick-setting glues, because quick-setting glues tend to stick to the rollers, making cleaning necessary after a few hours. Cleaning entails costs, and furthermore, loss of production. Thus, nozzle spraying is preferred.

It is provided in another advantageous embodiment that the insert is compressed in the direction of production and expansible. This reduces transport costs, storage costs and provision costs. Such an expansible insert can be expanded continuously, i.e. in the context of the method for the continuous manufacture of lightweight panels, in contrast to the state of the art, wherein the individual insert panels must be provided and inserted. Honeycomb panels and inserts of corrugated material of paper or cardboard are examples for expansible inserts.

On the one hand, if the expansible insert is coated with glue prior to expansion, one can cut down on glue compared to the conventional methods in which the cover layer is coated entirely. Furthermore, the transfer of the glue onto the insert can be effected particularly simply because the compressed insert absorbs glue over the entire surface. That is the reason why rollers can be used instead of the technically complex nozzles. In addition, the glue can be applied particularly thickly, and can thus penetrate the material, for example cardboard, deeply, from which its durability and load capacity benefit. This also enables the use of papers and cardboards having a small cross-section, where the absorption of glue on the bridge, which is only thin, would be more problematic in the expanded state.

In the method according to the invention, the two cover layers can basically be joined to the insert or the bar either one after the other or at the same time. A particularly short process path can of course be obtained if both cover layers, the insert, and optionally, the bar, are sandwiched together at the same time. The invention also covers the case where the second cover layer consisting of, for example, a material that is not processable in the continuous method is applied in another way, for example discontinuously. For example, that may be the case for a lightweight panel that is to have certain properties on one side. For example a kitchen countertop, work benchtop or work tabletop whose upper cover panel consists of a strong MDF panel, thus resisting impacts of knives or hammers. What makes such a lightweight panel special is that an attractive outward appearance (thick, high-quality wall thickness) is combined with a low weight (insert with low specific density) and finally high load capacity of only one surface (MDF panel).

A similar compromise can be achieved if, in certain sections, the lightweight panel has a solid insert instead of the light insert. A massive chipboard panel, MDF panel, HDF panel or the like may for example constitute a solid insert. It is essential that there is a zone of the lightweight panel that is able to resist greater loads. Thus, it is conceivable, for example in the case of kitchen countertops in the kitchen, that zones of greater load capacity be provided near the hotplates. Thus, a particularly light and inexpensive panel is obtained which withstands increased loads in the areas provided therefor. It has been shown that great loads of the kitchen countertop occur more frequently in certain places. The reinforced zone can of course be set off by different colors (light wood/dark wood design; wood/stone design) and marked. The reinforced zone differs from the bars used and known from the prior art in that they are not, in essence, intended for forming the edge of the panel and to reinforce it, and that it is therefore, for example, disposed in the central area of the panel and, if necessary, framed by the bars. Therefore, a solid insert according to the invention, which differs from the known bars at the edges, is:

a) an insert at the edge which protrudes more than 5 cm, preferably 10 cm, and particularly preferably 20 cm into the panel, which is therefore too deep to be considered merely a reinforcement of the edges in an economical sense,
b) an insert that does not itself form an edge of a panel,
c) a round insert, which does not form an edge of the panel, having a diameter of 20 cm, preferably 40 cm, and particularly preferably 70 cm, or
d) an insert whose edges have a length of at least 20 cm, preferably 40 cm, and particularly preferably 60 cm.

For design reasons, such lightweight kitchen countertops or worktops can have the appearance and thickness of a massive panel. This can be done, for example, by veneers with/without overlay, decorative papers with/without overlay, wear-resistant overlays and other design features as they are known from the field of laminate floorings and the furniture industry. It must be considered an advantage that only 2 meters out of 10 meters of kitchen front, for example, are massive, heavy and expensive. The observer, however, gets the impression of a high-grade continuous worktop with a length of 10 meters.

According to the invention, a panel is additionally specified wherein a lightweight panel forms a common plane with further panels (lightweight or any other panels), and wherein it is fixedly or detachably connected with it along the common lateral edge. From the prior art, it is only known to connect lightweight panel in the area of the bars at a right angle by means of connecting means known from furniture construction (mostly nut-and-bolt connections), into which the bars are inserted.

It is provided in another embodiment that at least one of the adjacent edges is without bars. This makes providing and inserting/connecting the bars, which takes a lot of effort, superfluous in part. A section of the bar protruding at one of the two panels may, for example, be fit into the bar-free edge of the adjacent panel.

Alternatively, bar-free edges can be connected by suitable measures, e.g. WoodWelding technology, which until now has only been used for connecting light panels. An undetachable technology of the type of the one-way connection is advantageous in this case, since the fastening means can be invisible in the assembled state in this case.

If, according to the invention, a connection of several panels in the same plane is provided, e.g. for creating a U-shaped kitchen countertop panel, new areas of application for the use of lightweight panels or combinations of lightweight panels and massive panels in higher load range are the result.

It was also recognized according to the invention that the use of lightweight panels was limited until now to furniture, doors, walls and the like, because these are components with a small local surface load. That is the reason why the person skilled in the art had until now not used such panels for worktops and kitchen countertops. However, this is readily possible, at least with the panels or methods specified according to the invention.

The above-mentioned features concerning the configuration of the panels, such as, for example, asymmetrical cover layers, solid insert, etc can be implemented independently from the method for the continuous production of the panels specified in this application.

BRIEF DESCRIPTION OF THE DRAWINGS

Further advantages become apparent from the following description and the attached drawing. Also, the above-mentioned features, which will be explained further, according to the invention can each be used individually or in any combination. The embodiments mentioned shall not be understood to be final, and they have the character of examples.

DETAILED DESCRIPTION OF THE PRESENT INVENTION

Figure 1:
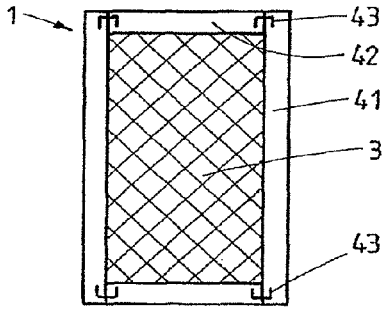
FIGS. 1 and 2 shows start of the art of manufacturing lightweight panels.
Figure 2:
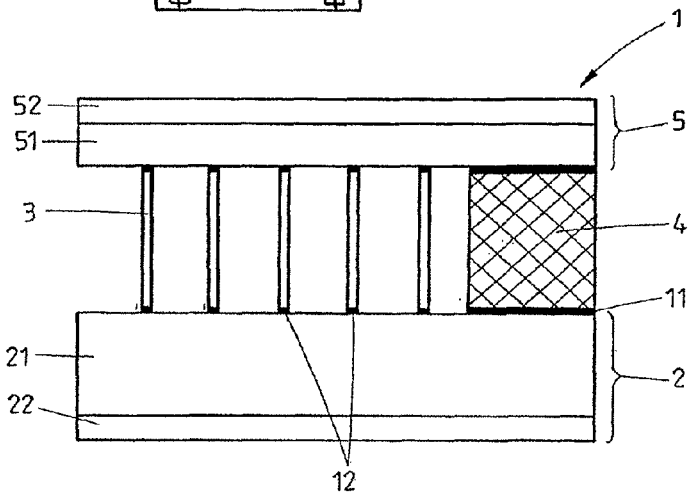
Figure 3:
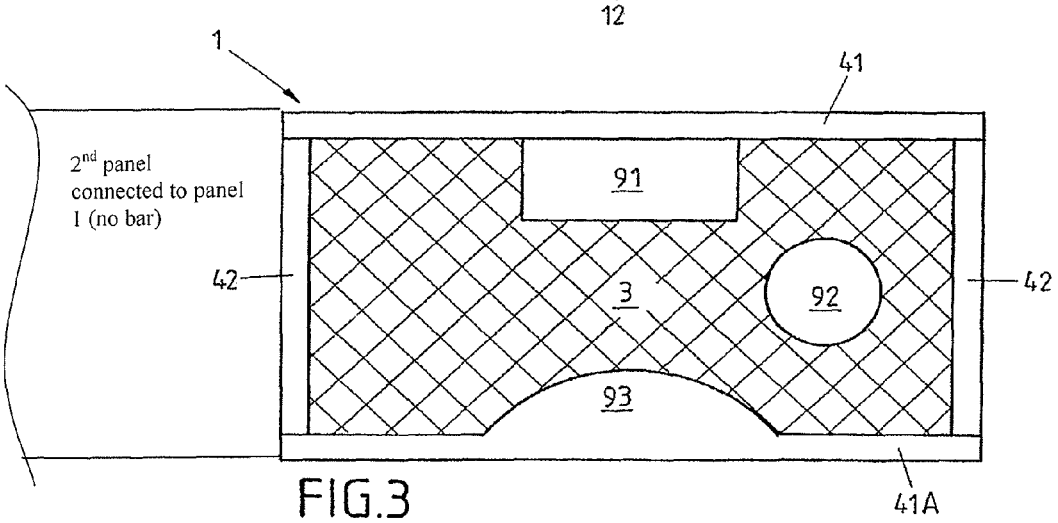
FIG. 3 shows a lightweight panel according to the invention.

FIG. 3 shows a lightweight panel according to the invention with the solid inserts 91, 92, 93 for creating a load capacity that is higher locally. The lightweight panel 1 consists of transversal and longitudinal bars 41, 41*a* and 42 enclosed between two horizontal cover layers. They form the mechanical and optical lateral boundary of the lightweight panel 1. The area 3 enclosed by the bars 41, 41*a*, 42 substantially consists of the honeycomb insert. This is only interrupted by solid inserts 91, 92, 93 forming zones of higher load capacity. These inserts can, for example, consist of the same material as the longitudinal and transversal bars 41, 42 and, of course, have the same material strength. The lower longitudinal bar 41*a* forming, for example, the front edge of a writing desk, has, for example, a crescent-shaped, round, solid insert 93, which gives the user the impression, at least in the area of the table's edge, of higher quality due to the increased strength and the accompanying more massive sound of the table panel. As shown in FIG. 3, the insert 93 may be formed in one piece with the longitudinal bar 41*a*, or the corresponding bar at the edge is simply broadened, which is not shown in FIG. 3. In contrast, the reinforcements 91, 92 are laid in the interior of the table panels 1 independently from the bars 41, 42, and define zones of higher load capacity, for example for the computer monitor. The most important thing is that the panels has properties of greater strength, or that it gives the user an impression of greater quality due to its massive sound, where increased loads usually occur.

The invention claimed is:

1. A method for the continuous manufacture of lightweight panels from an endless panel having an insert glued to one cover layer on at least one side and bars glued to the cover layer, comprising:

gluing the cover layer to the insert and the bars under line pressure, wherein the line pressure is guided along the lightweight panels, and dividing the endless panel into several of the lightweight panels in an area of the bars in such a manner that a single bar forms an edge of two adjacent lightweight panels after dividing, wherein the insert is an expansible insert which is expanded continuously, cut to length if necessary, and connected with the cover layer.

2. The method according to claim 1, wherein longitudinal bars are used exclusively and the dividing takes place in a transversal direction with respect to the longitudinal bars.

3. The method according to claim 1, wherein the line pressure is guided along the lightweight panels several consecutive times.

4. The method according to claim 1, wherein the line pressure is exerted until adhesive used during the gluing has hardened.

5. The method according to claim 1, wherein one of a roller, a pair of rollers pressing against each other, several consecutively arranged rollers and pairs of rollers are used for applying the line pressure.

6. The method according to claim 1, wherein the insert is compressed in a direction of production and is then expanded.

7. A lightweight panel of an endless panel, comprising:

an insert glued to one cover layer on at least one side; and bars glued to the cover layer, wherein the endless panel comprises several of the lightweight panels such that a single bar forms an edge of two adjacent lightweight panels, wherein the insert is an expansible insert which is expanded continuously, cut to length if necessary, and connected with the cover layer.

8. The panel according to claim 7, wherein the endless panel comprises at least three longitudinal bars, the endless panel being divided into several webs in the area of the longitudinal bars.

9. The panel according to claim 8, wherein the endless panel includes four longitudinal bars.

10. The panel according to claim 7, further comprising two cover layers which have at least one of different materials, material properties and material thickness.

11. The panel according to claim 7, further comprising two cover layers which have a different mechanical load capacity.

12. The panel according to claim 7, wherein the bars are longitudinal bars connected with the endless panel in its longitudinal direction.

13. The panel according to claim 12, wherein the longitudinal bars are arranged offset relative to a length of the lightweight panels.

14. The panel according to claim 7, wherein edges and corners of the lightweight panels are a particular shape.

15. The panel according to claim 7, wherein edges at which the insert is exposed are reinforced.

16. The panel according to claim 7, wherein adhesive used for the gluing is one of applied directly onto the bars and applied to the cover layer only where the bars are placed.

17. The panel according to claim 7, wherein adhesive used for the gluing is applied to the insert, substantially only where a connection with the cover layer is established.

18. The panel according to claim 17, wherein the adhesive used for the gluing is applied to the insert of a honeycomb panel.

19. The panel according to claim 7, wherein the expansible insert is provided with adhesive.

20. The panel according to claim 7, further comprising, simultaneously or consecutively, two cover layers above and beneath the insert are connected with the insert or the bars.

21. The panel according to claim 7, wherein one of the following adhesives is used for the glue: NR (natural rubbers), glues, UF resins, MF resins, PE resins, RF resins, starch, dextrin, casein, PVAL, PVP, cellulose ether and PU adhesive.

22. The panel according to claim 21, wherein the glue is glutine glues.

23. The panel according to claim 7, wherein the expansible insert is compressed at least in the direction of the production.

24. The panel according to claim 7, wherein, simultaneously or consecutively, the two cover layers above and beneath the insert, and the bar, are connected with the insert or the bar.

25. The panel according to claim 7, wherein the insert absorbs the glue over an entire surface, in a compressed state.

26. A lightweight panel comprising cover layers that are connected on both sides with bars;

a solid insert in an at least an interior area of the cover layers and configured to resist loads; and an insert positioned within an area within the bars and which is interrupted by the solid insert, wherein the insert is an expansible insert which is expanded continuously and connected with the cover layer.

27. The panel according to claim 26, wherein the solid insert protrudes more than 5 cm from an edge of the panel.

28. The panel according to claim 27, wherein the panel is configured and structured for use in a kitchen countertop, work benchtop or work tabletop.

29. The panel according to claim 27, wherein the solid insert protrudes 10 cm into the panel.

30. The panel according to claim 27, wherein the solid insert protrudes 20 cm into the panel.

31. The panel according to claim 26, wherein the solid insert is away from an edge of the panel.

32. The panel according to claim 26, wherein the solid insert forms a round insert having a diameter of 20 cm, and does not form an edge of the panel.

33. The panel according to claim 26, wherein edges of the solid insert have a length of at least 20 cm.

34. The panel according to claim 26, wherein the lightweight panel is arranged next to a second lightweight panel or any other panel with a same orientation, and is connected with it along a mutual lateral edge by one of a nondetachable connection and by a one way connection.

35. The panel according to claim 26, wherein the lightweight panel is arranged next to a second lightweight panel or any other panel with a same orientation, and is connected with it along a mutual lateral edge wherein at least one of the lightweight panels is without bars along a lateral edge.

36. The panel according to claim 26, wherein the solid insert forms a round insert having a diameter of 40 cm and does not form an edge of the panel.

37. The panel according to claim 26, wherein the solid insert forms a round insert having a diameter of 70 cm and does not form an edge of the panel.

38. The panel according to claim 26, wherein edges of the solid insert have a length of 40 cm.

39. The panel according to claim 26, wherein edges of the solid insert have a length of 60 cm.

40. The panel according to claim 26, wherein the cover layers are two cover layers which have at least one of different materials, material properties and material thickness.

41. The panel according to claim 26, wherein the cover layers are two cover layers which have a different mechanical load capacity.

42. The panel according to claim 26, further comprising adhesive used for gluing is directly onto the bars and applied to a cover layer of the cover layers only where the bars are placed.

43. The panel according to claim 42, wherein one of the following adhesives is used for the glue: NR (natural rubbers), glues, UF resins, MF resins, PE resins, RF resins, starch, dextrin, casein, PVAL, PVP, cellulose ether and PU adhesive.

44. The panel according to claim 42, wherein the adhesive used for the gluing is applied to the insert which is a honeycomb panel.

45. The panel according to claim 26, wherein the expansible insert is compressed at least in the direction of the production.

46. Apparatus for carrying out the method according to claim 1.

* * * * *